US007728212B2

(12) United States Patent
Fujishima et al.

(10) Patent No.: US 7,728,212 B2
(45) Date of Patent: Jun. 1, 2010

(54) MUSIC PIECE CREATION APPARATUS AND METHOD

(75) Inventors: Takuya Fujishima, Hamamatsu (JP); Naoaki Kojima, Tokyo (JP); Kiyohisa Sugii, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 11 days.

(21) Appl. No.: 12/218,163

(22) Filed: Jul. 11, 2008

(65) Prior Publication Data

US 2009/0013855 A1 Jan. 15, 2009

(30) Foreign Application Priority Data

Jul. 13, 2007 (JP) ..... 2007-184052

(51) Int. Cl.
*G10H 1/00* (2006.01)

(52) U.S. Cl. ..... 84/600; 84/609; 84/649; 700/94

(58) Field of Classification Search ..... 84/600–604, 84/609, 616, 649, 654; 700/94
See application file for complete search history.

(56) References Cited

U.S. PATENT DOCUMENTS 4,947,723 A * 8/1990 Kawashima et al. ..... 84/603
5,235,124 A * 8/1993 Okamura et al. ..... 434/307 A
5,471,009 A * 11/1995 Oba et al. ..... 84/645
5,536,902 A * 7/1996 Serra et al. ..... 84/623
5,680,512 A * 10/1997 Rabowsky et al. ..... 704/504
5,792,971 A * 8/1998 Timis et al. ..... 84/609
5,805,685 A * 9/1998 McFarlen ..... 379/189
5,857,171 A * 1/1999 Kageyama et al. ..... 704/268
5,918,302 A * 6/1999 Rinn ..... 84/604
5,955,693 A * 9/1999 Kageyama ..... 84/610
6,240,448 B1 * 5/2001 Imielinski et al. ..... 709/218
6,449,661 B1 * 9/2002 Fujishima ..... 710/5
6,506,969 B1 * 1/2003 Baron ..... 84/609
6,725,108 B1 * 4/2004 Hall ..... 700/94
6,759,954 B1 * 7/2004 Myron et al. ..... 340/522
6,853,686 B1 * 2/2005 Cupo et al. ..... 375/259
7,189,913 B2 * 3/2007 Moulios et al. ..... 84/612
7,257,452 B2 * 8/2007 Wiser et al. ..... 700/94
2003/0078978 A1 * 4/2003 Lardin et al. ..... 709/206

(Continued)

FOREIGN PATENT DOCUMENTS

EP 1646035 A1 4/2006

(Continued)

*Primary Examiner*—David S. Warren
(74) *Attorney, Agent, or Firm*—Pillsbury Winthrop Shaw Pittman LLP

(57) ABSTRACT

Music piece data composed of audio waveform data are stored in a memory. Analysis section analyzes the music piece data stored in the memory to determine sudden change points of sound condition in the music piece data. Display device displays individual sound fragment data, obtained by dividing the music piece data at the sudden change points, in a menu format having the sound fragment data arranged therein in order of their complexity. Through user's operation via an operation section, desired sound fragment data is selected from the menu displayed on the display device, and a time-axial position where the selected sound fragment data is to be positioned is designated. New music piece data set is created by each user-selected sound fragment data being positioned at a user-designated time-axial position.

10 Claims, 6 Drawing Sheets

U.S. PATENT DOCUMENTS

2003/0105747 A1* 6/2003 Ishida et al. ..... 707/3
2003/0172079 A1* 9/2003 Millikan et al. ..... 707/100
2004/0122663 A1* 6/2004 Ahn et al. ..... 704/221
2004/0249489 A1* 12/2004 Dick ..... 700/94
2004/0252604 A1* 12/2004 Johnson et al. ..... 369/47.22
2004/0264917 A1* 12/2004 Braun et al. ..... 386/46
2005/0188820 A1* 9/2005 Park et al. ..... 84/603
2006/0074649 A1 4/2006 Pachet et al.
2006/0106900 A1* 5/2006 Millikan et al. ..... 707/205
2006/0235702 A1* 10/2006 Koinuma ..... 704/276
2006/0236846 A1* 10/2006 Nishibori ..... 84/603
2007/0137464 A1* 6/2007 Moulios et al. ..... 84/612
2007/0271093 A1* 11/2007 Wang et al. ..... 704/210
2007/0271241 A1* 11/2007 Morris et al. ..... 707/3
2008/0013757 A1* 1/2008 Carrier ..... 381/119
2008/0027731 A1* 1/2008 Shpiro ..... 704/276
2008/0030462 A1* 2/2008 Lasar ..... 345/156
2008/0115658 A1* 5/2008 Fujishima et al. ..... 84/618
2008/0154407 A1* 6/2008 Carson ..... 700/94
2008/0190272 A1* 8/2008 Taub et al. ..... 84/645
2008/0235025 A1* 9/2008 Murase et al. ..... 704/260
2009/0013855 A1* 1/2009 Fujishima et al. ..... 84/604
2009/0048852 A1* 2/2009 Burns et al. ..... 704/503
2009/0132243 A1* 5/2009 Suzuki ..... 704/216
2009/0217805 A1* 9/2009 Lee et al. ..... 84/611

FOREIGN PATENT DOCUMENTS

JP 2006-106754 4/2006

* cited by examiner

MUSIC PIECE CREATION APPARATUS AND METHOD

BACKGROUND

The present invention relates to an apparatus and method for creating a music piece by interconnecting sound fragments.

Among the conventionally-known music piece creation techniques is a technique called "audio mosaicing". According to the audio mosaicing technique, various music pieces are divided into sound fragments of short time lengths, so that sound fragment data indicative of waveforms of the individual sound fragments are collected to build a sound fragment database. Desired sound fragment data are selected from the sound fragment database, and then the selected sound fragment data are interconnected on the time axis to thereby edit or create a new music piece. Examples of literatures pertaining to this type of technique include:

[non-patent literature 1] Ari Lazier, Perry Cook, "MOSIEVIUS: FEATURE DRIVEN INTERACTIVE AUDIO MOSAICING", [on line], Proc of the 6th Int. Conference on Digital Audio Effects (DAFx-03), London, UK, Sep. 8-11, 2003 [searched Mar. 2, 2007], Internet<URL: http://soundlab.cs.princeton.du/publications/mosievius_dafx__2003.pdf>; and

[non-patent literature 2] Bee Suan Ong, Emilia Gomez, SebastianStreich, "Automatic Extraction of Musical Structure Using Pitch Class Distribution Features", [on line], Learning the Semantics of Audio Signals (LSAS) 2006, [searched on Mar. 6, 2007], Internet<URL: http://irgroup.cs.uni-magdeburg.de/lsas2006/proceedings/LSAS06__053__065.pdf>.

In order to obtain expressive music piece data, it is necessary to prepare in advance a variety of sound fragment data having various characteristics and select and interconnect suitable ones of the sound fragment data. However, finding desired sound fragment data from among the enormous quantity of the sound fragment data is very hard work.

SUMMARY OF THE INVENTION

In view of the foregoing, it is an object of the present invention to provide an improved music piece creation apparatus, method and program which can facilitate user's operation for selecting sound fragment data when creating a music piece by interconnecting desired sound fragment data.

In order to accomplish the above-mentioned object, the present invention provides an improved music piece creation apparatus, which comprises: a storage section that stores music piece data composed of audio waveform data; an analysis section that analyzes the music piece data stored in the storage section to determine sudden change points of sound condition in the music piece data; a display device; a display control section that causes the display device to display individual sound fragment data, obtained by dividing at the sudden change points the music piece data stored in the storage section, in a menu format having the sound fragment data arranged therein in order of complexity; an operation section operable by a user, the operation section accepting user's operation for selecting desired sound fragment data from the menu displayed on the display device and user's operation for designating a time-axial position where the selected sound fragment data is to be positioned; and a synthesis section that synthesizes new music piece data by positioning each sound fragment data, selected from the menu through user's operation via the operation section, at a time-axial position designated through user's operation via the operation section.

According to the present invention, the music piece data are divided at the sudden change points into sound fragment data, and a menu indicative of the individual sound fragment data as materials to be used for creation of a music piece is displayed on the display device. At that time, a menu indicating the sound fragment data is displayed on the display device in such a manner that the individual sound fragment data are displayed in the order of their structural complexity. Thus, the user can readily find any desired sound fragment data.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other characteristics of the present invention, its preferred embodiments will be described hereinbelow in greater detail with reference to the accompanying drawings, in which.

DETAILED DESCRIPTION

Figure 1:
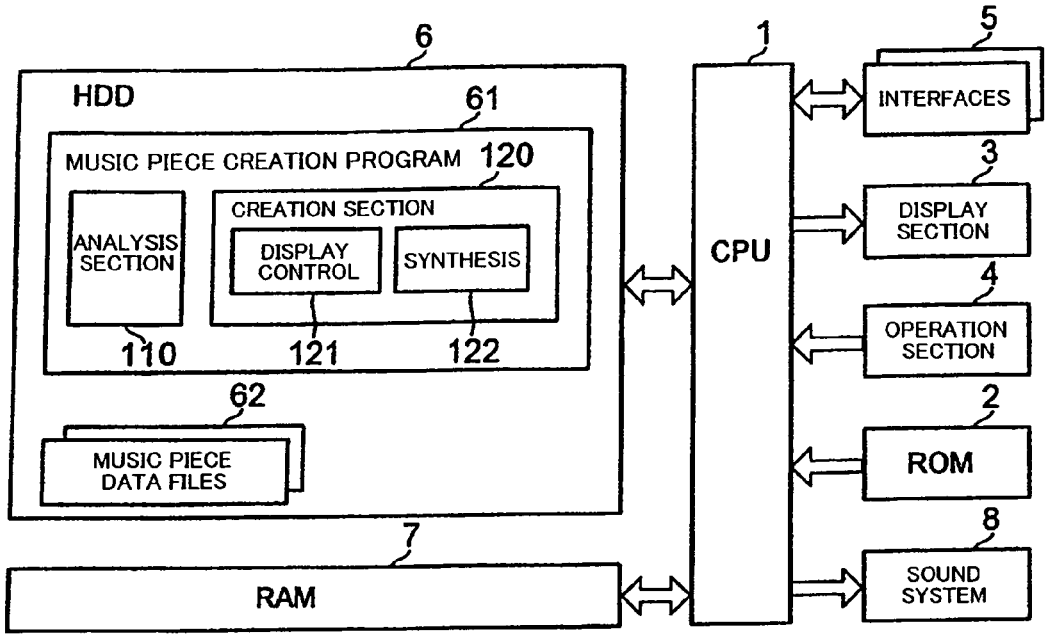
FIG. 1 is a block diagram showing a general setup of a music piece creation apparatus according to an embodiment of the present invention.

FIG. 1 is a block diagram showing a general setup of a music piece creation apparatus according to an embodiment of the present invention. This music piece creation apparatus is implemented, for example, by installing into a personal computer a music piece creation program according to the embodiment of the present invention.

In FIG. 1, a CPU 1 is a control center for controlling various sections or components of the music piece creation apparatus. ROM 2 is a read-only memory having stored therein control programs, such as a loader, for controlling fundamental behavior of the music piece creation apparatus.

Display section (display device) 3 is a device for displaying operational states of and input data to the music piece creation apparatus, messages to a human operator or user, etc., and it comprises, for example, a liquid crystal display (LCD) panel and a drive circuit therefor. Operation section 4 is a means for accepting various commands, instructions, and information from the user, and it comprises various operating members (operators). In a preferred implementation, the operation section 4 includes a keyboard and a pointing device, such as a mouse.

Interfaces 5 include a network interface for the music piece creation apparatus to communicate data with other apparatus via a communication network, drivers for communicating data with external storage media, such as a magnetic disk and CD-ROM.

HDD (Hard Disk Device) 6 is a non-volatile storage device for storing various programs and databases. RAM 7 is a volatile memory for use as a working area by the CPU 1. In accordance with an instruction given via the operation section 4, the CPU 1 loads any of the programs, stored in the HDD 6, to the RAM 7 for execution of the program.

Sound system 8 is a means for audibly sounding (i.e., producing audible sounds of) a music piece edited or being edited in the music piece creation apparatus. The sound system 8 includes a D/A converter for converting a digital audio signal, which is sound sample data, into an analog audio signal, an amplifier for amplifying the analog audio signal, a speaker for outputting an output signal of the amplifier as an audible sound, etc. In the instant embodiment, the sound system 8, display section 3 and operation section 4 function as interfaces for not only supplying the user with information pertaining to creation of a music piece but also accepting user's instructions pertaining to creation of a music piece.

Among information stored in the HDD 6 are a music piece creation program 61 and one or more music piece data files 62.

The music piece data files 62 are each a file containing sets of music piece data that are time-serial sample data of audio waveforms of musical instrument performance tones, vocal sounds, etc. in a given music piece; music piece data sets of a plurality of music pieces may be prestored in the HDD 6. In a preferred implementation, such music piece creation program 61 and music piece data files 62 are downloaded from a site in the Internet via a suitable one of the interfaces 5 and then installed into the HDD 6. In another preferred implementation, the music piece creation program 61 and music piece data files 62 are traded in a computer-readable storage medium, such as a CD-ROM, MD or the like; in this case, the music piece creation program 61 and music piece data files 62 are read out from the storage medium via the suitable one of the interfaces 5 and then installed into the HDD 6.

The music piece creation program 61 includes two main sections: an analysis section 110; and a creation section 120. The analysis section 110 is a routine that loads music piece data of any of the music piece data files 62, designated through operation via the operation section 4, into the RAM 7, analyzes the loaded music piece data and then generates music piece composing data in the RAM 7. The music piece composing data include sudden change point data indicative of sudden change points, each of which is a time point where sound condition suddenly changes in the music piece data, and musical characteristic data indicative of musical characteristics of individual sound fragment data in each of sections of the music piece data divided at the sudden change points. In the instant embodiment, degrees or levels of importance of the sudden change points are classified into three levels, level 1-level 3; level 1 is the lowest importance level while level 3 is the highest importance level. Each of the sudden change point data includes information indicative of a position of the sudden change point determined using the beginning of the music piece as a determining basis, and information indicative of which one of level 1-level 3 the importance of the sudden change point is at. The importance of each of the sudden change points may be determined in any one of several manners, as will be later described. Further, the analysis section 110 obtains information indicative of structural complexity of sound fragment in each of the sections obtained by dividing the music piece data at the sudden change points. Each of the sudden change point data includes information indicative of structural complexity of sound fragments starting at the sudden change point indicated by the sudden change point data.

The creation section 120 of the music piece creation program, 61 divides the music piece data, stored in the RAM 7, at the sudden change points indicated by the sudden change point data included in the music piece composing data corresponding to the music piece data, to thereby provide a plurality of sound fragment data, and then, in accordance with an instruction given by the user via the operation section 4, the creation section 120 interconnects selected ones of the sound fragment data to thereby synthesize new music piece data. In this case, new music piece data may be synthesized or created using music piece composing data extracted from a plurality of music pieces, rather than music piece composing data extracted from just one music piece.

The creation section 120 includes a display control section 121 and a synthesis section 122. The display control section 121 is a routine that divides the music piece data, stored in the RAM 7, into a plurality of sound fragment data on the basis of the sudden change point data included in the music piece composing data and causes the display section 3 to display the individual sound fragment data in a menu format having the sound fragment data arranged therein in order of ascending structural complexity, i.e. from low structural complexity to high structural complexity. Here, the menu of the individual sound fragment data also includes marks indicative of musical characteristic data associated with the sound fragment data. Further, in the instant embodiment, the user can designate, through operation via the operation section 4, a level of importance of the sudden change point as a condition of the sudden change point data to be used for the division of the music piece data. In this case, the display control section 121 divides the music piece data into a plurality of sound fragment data using some of the sudden change point data in the music piece composing data which correspond to the user-designated level.

The synthesis section 122 is a so-called grid sequencer. In the instant embodiment, the synthesis section 122 not only secures a music piece track for storing music piece data, which are time-serial waveform data, in the RAM 7, but also causes the display section 3 to display a grid indicative of a time axis scale of the music piece track. Once one of the sound fragment data displayed in the menu on the display section is selected through user's operation via the operation section 4 (more specifically, the pointing device), the synthesis section 122 identifies a section of the music piece data in the RAM 7 where the sound fragment data selected via the operation section 4 is located, with reference to the music piece data composing data in the RAM 7. Then, the sound fragment data of the section is cut out and read out from among the music piece data in the RAM 7. Then, once one of the grid points displayed on the display section 3 is designated through user's operation via the operation section 4, the sound fragment data is stored into a successive region, located in the music piece track of the RAM 7, starting at an address corresponding to the designated grid point. The synthesis section 122 repeats such operations in accordance with user's operation via the operation section 4, to interconnect various sound fragment data and thereby generate new music piece data in the music piece track in the RAM 7.

In the instant embodiment, new music piece data can be synthesized using sound fragment data obtained by dividing a plurality of the stored music piece data sets at sudden change points, rather than by dividing only one stored music piece data set at sudden change points. In such a case, the user designates a plurality of music piece data files 62 through operation via the operation section 4. In such a case, the analysis section 110 loads the respective music piece data sets of the designated music piece data files 62 into the RAM 7, creates music piece composing data for each of the music piece data sets and stores the thus-created music piece composing data into the RAM 7 in association with the original music piece data sets. Then, the display control section 121 divides each of the music piece data sets into a plurality of sound fragment data on the basis of the sudden change point data included in the corresponding music piece composing data and then causes the display section 3 to display a menu having the individual sound fragment data arranged therein in the order of ascending complexity. The menu may be displayed in any one of various display styles; for example, the sound fragment data menus of the individual music pieces may be arranged in a horizontal direction, and the sound fragment data menus may be arranged in a vertical direction in the order of the complexity of the sound fragment data. Behavior of the synthesis section 122 in this case is similar to that in the case where only one original music data set is divided.

Next, a description will be given about behavior of the instant embodiment. When music piece data are to be created, the user instructs activation of the music piece creation program 61 through operation via the operation section 4, in response to which the CPU 1 loads the music piece creation program 61 into the RAM 7 and then executes the loaded program 61. Once the user designates any one of the music piece data files 62 through operation via the operation section 4, the analysis section 110 of the music piece creation program 61 loads the designated music piece data file 62 into the RAM 7 and then analyzes the loaded music piece data file 62 to thereby generate music piece composing data.

Figure 2:
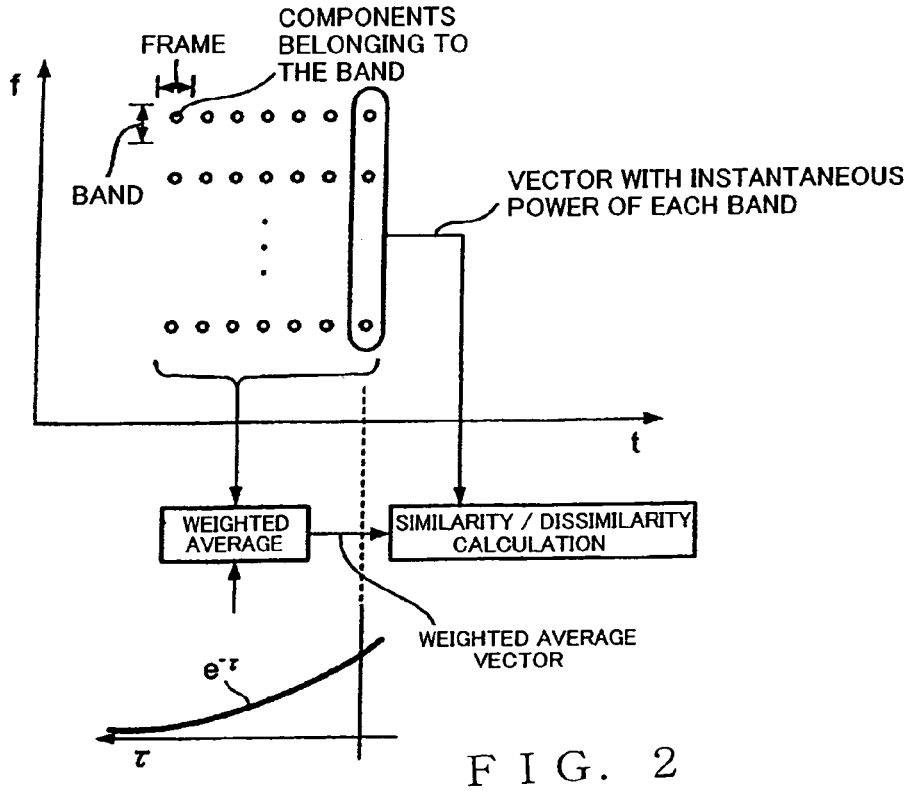
FIG. 2 is a diagram showing an example of a sudden change point detection process performed in the embodiment of the present invention.

The analysis section 110 detects sudden change points of sound condition in audio waveforms indicated by the stored music piece data, in order to generate music piece composing data from the music piece data. The sudden change points may be detected in any one of various styles. In one style, the analysis section 110 divides the audio waveforms, indicated by the music piece data, into a plurality if frequency bands per frame of a predetermined time length, and then it obtains a vector comprising instantaneous power of each of the frequency bands. Then, as shown in FIG. 2, the analysis section 110 performs calculations for determining, for each of the frames, similarity/dissimilarity between the vector comprising the instantaneous power of each of the frequency bands (i.e., band frequency components) and a weighted average vector of vectors in several previous frames. Here, the weighted average vector can be obtained by multiplying the individual vectors of the several previous frames by exponent function values that decrease in the reverse chronological order; that is, the older the frame, the smaller the exponent function value. Then, for each of the frames, the analysis section 110 determines whether there has occurred a prominent negative peak in similarity between the vector of that frame and the weighted average vector of the several previous frames (namely, whether that frame has become dissimilar), and, if so, the analysis section 110 sets the frame as a sudden change point.

In the similarity/dissimilarity determining calculations, there may be used, as a similarity/dissimilarity criterion, any of the conventionally-known distance measures, such as the Euclidean distance and cosine angle, between the two vectors to be compared. Alternatively, the two vectors may be normalized and the thus-normalized vectors may be considered as probability distributions, and a KL information amount between the probability distributions may be used as a similarity/dissimilarity index. In another alternative, there may be employed a criterion of "setting, as a sudden change point, any point where a prominent change has occurred even in a single frequency band".

In the instant embodiment, the scheme for determining the sudden change points is not limited to the aforementioned scheme based on band frequency components per frame; for example, there may be employed a scheme in accordance with which each point where the tone volume or other tone factor indicated by the music piece data suddenly changes is set as a sudden change point. In another alternative, sudden change points of a plurality of types of tone factors, rather than a single type of tone factor, may be detected.

Further, in detecting the sudden change points from the music piece data, the analysis section 110 determines (i.e., sets) a degree or level of importance of each of the sudden change points. In a preferred implementation, the analysis section 110 compares a degree of similarity of each of the sudden change points, obtained through the similarity/dissimilarity calculations, against three different threshold values, to thereby determine or set a level of importance of each of the sudden change points. Namely, if the degree of similarity is smaller than the first threshold value but greater than the second threshold value that is smaller than the first threshold value, then the importance of the sudden change point in question is set at level 1, if the degree of similarity is smaller than the first and second threshold values but greater than the third threshold value that is smaller than the second threshold value, then the importance of the sudden change point in question is set at level 2, and if the degree of similarity is smaller than the third threshold value, then the importance of the sudden change point in question is set at level 3.

Figure 3:
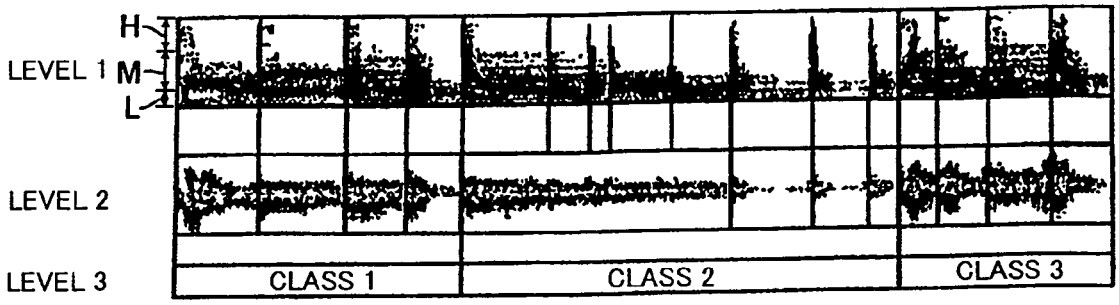
FIG. 3 is a diagram showing examples of sudden change points of various levels determined in the embodiment of the present invention.

In another implementation, the analysis section 110 determines (i.e., obtains) sudden change points of level 1-level 3 using various different methods, as illustratively shown in FIG. 3. In the illustrated example of FIG. 3, sudden change points of level 1 in the music piece data are determined using the aforementioned method which uses the division into frequency bands and similarity/dissimilarity calculations between vectors of band frequency components, each specific point of the sudden change points of level 1 where a clear rise occurs in the audio waveforms indicated by the music piece data is determined as a sudden change point of level 2, and each specific point of the sudden change points of level 2 which defines a clear boundary in the entire structure of the music piece pertaining to, for example, a beat point or boundary between measures (i.e., measure line) is set as a sudden change point of level 3.

More specifically, in the uppermost row of FIG. 3, there is shown a spectrogram of audio waveforms indicated by music piece data, where each sudden change point of level 1 is indicated by a line vertically extending through the spectrogram. These sudden change points are ones determined by the aforementioned method which uses the division into frequency bands and similarity/dissimilarity calculations between vectors. In this example, components of the audio waveforms indicated by the music piece data are divided into three frequency bands: low band L, medium band M and high band H. More specifically, the low band L is a band of 0-500 Hz capable of capturing bass drum sounds or bass guitar sounds, the medium band M is a band of 500-450 Hz capable of capturing snare drum sounds, the high band H is a band of over 450 Hz and over capable of capturing hi-hat cymbal sounds.

In the middle row of FIG. 3, there are shown audio waveforms indicated by music piece data, where each sudden change point of level 2 is indicated by a line vertically extending through the audio waveforms. These sudden change points of level 2 are some of the sudden change points of level 1 where a clear rise occurs in the audio waveforms.

In the low row of FIG. 3, there are shown sudden change points of level 3 in vertical straight lines dividing a horizontally-extending stripe. In the instant embodiment, each sound fragment data obtained by dividing the music piece data of the sudden change points of level 3 (i.e., highest level of importance) will be referred to as "class".

In the instant embodiment, synthesis of new music piece data is performed by interconnecting sound fragment data on a class-by-class basis, unless instructed otherwise by the user. Therefore, it is necessary for each sudden change point of level 3 to be a point reflecting a construction of the music piece. In a preferred implementation, in order to make each sudden change point of level 3 to reflect the construction of the music piece like this, beat points and bar or measure lines are detected by means of a well-known algorithm, and each given one of sudden change points of level 2 which is closest to a beat point or measure line is set as a sudden change point of level 3. Alternatively, a chord sequence of the music piece may be obtained from the music piece data, and each given one of sudden change points of level 2 which is closest to a chord change point may be set as a sudden change point of level 3. The chord sequence may be obtained, for example, in the following manner.

First, harmony information indicative of a feeling of sound harmony, such as HPCP (Harmonic Pitch Class Profile) information, is extracted from individual sound fragment data obtained through, for example, music piece data division at sudden change points of level 1, to provide a harmony information train H(k) (k=0-n−1). Here, "k" is an index representing a time from the beginning of the music piece; k=0 represents the start position of the music piece and k=n−1 represents the end position of the music piece. Two desired pieces of harmony information H(i) and H(j) are taken out from among the n pieces of harmony information H(k) (k=0-n−1), and a degree of similarity between the taken-out harmony information H(i) and H(j) is calculated. Such operations are performed for each pair of pieces of harmony information H(i) and H(j) (i=0-n−1) (j=0-n−1), to thereby create a degree-of-similarity matrix L (i, j) (i=0-n−1, j=0-n−1).

Figure 4A:
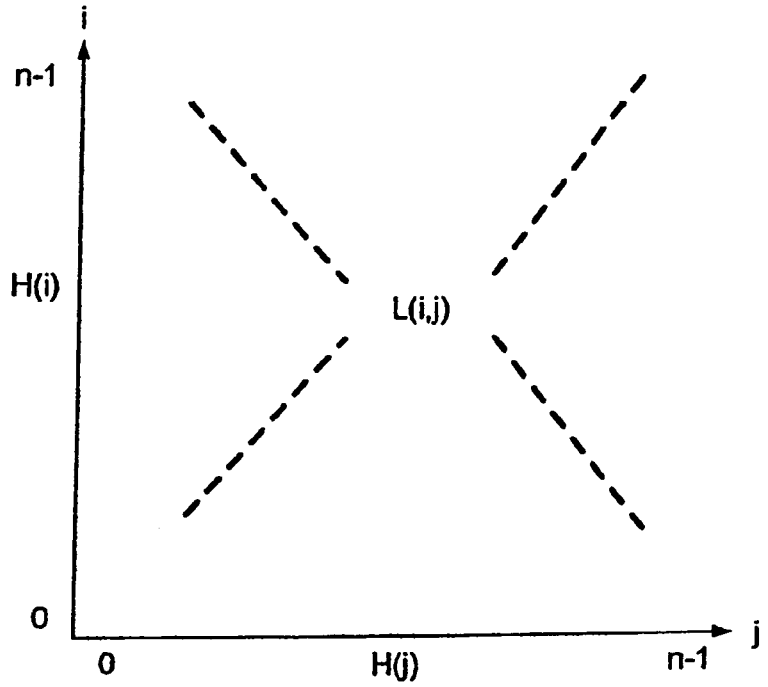
FIGS. 4A and 4B are diagrams showing a chord sequence analysis method to be employed for determining sudden change points of level 3 in the embodiment of the present invention.
Figure 4B:
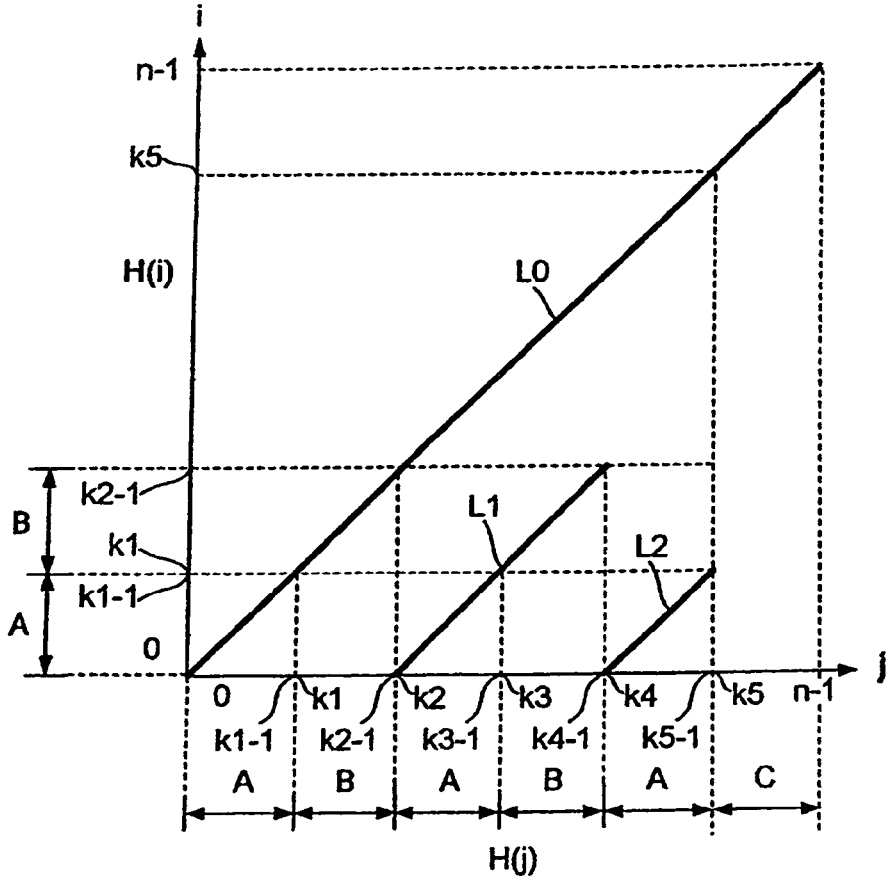

Then, a successive region where the degree of similarity L is equal to or greater than a threshold value is obtained of a triangle matrix (i, j) (i=0-n−1, j≧1) that is part of the degree-of-similarity matrix L (i, j) (i=0-n−1, j=0-n−1). In FIG. 4B, regions indicated by black heavy lines represent successive regions having high degrees of similarity (hereinafter referred to as "high-degree-of-similarity successive regions") obtained through such an operation. When a plurality of such high-degree-of-similarity successive regions have been obtained, the instant embodiment finds a harmony information pattern that repetitively appears in the harmony information train H(k) (k=0-n−1), on the basis of overlapping relationship on the i axis among occupied ranges of the high-degree-of-similarity successive regions.

In the illustrated example of FIG. 4B, the degree-of-similarity matrix L (i, j) (i=0-n−1, j=0-n−1) includes, as collections of degree of similarity between the harmony information, a high-degree-of-similarity successive region L0 and two other high-degree-of-similarity successive regions L1 and L2. The high-degree-of-similarity successive region L1 shows that a harmony information train H(j) (j=k2-k4−1) of an intermediate section of the music piece is similar to a harmony information train H(i) (i=0-k2−1) of a section of the music piece starting at the beginning of the music piece. Further, the high-degree-of-similarity successive region L2 shows that a harmony information train H(j) (j=k4-k5−1) of a section immediately following the section of the music piece corresponding to the high-degree-of-similarity successive region L1 is similar to the harmony information train H(i) (i=0-k1) of a section of the music piece starting at the beginning of the music piece.

The following will be seen by looking at the overlapping relationship on the i axis between the occupied ranges of the high-degree-of-similarity successive regions L1 and L2. First, the harmony information train H(j) (j=k2-k4−1) of the section corresponding to the high-degree-of-similarity successive region L1 is similar to the harmony information train H(i) (i=0-k2−1) of the section of the music piece starting at the beginning of the music piece, and the harmony information H(i) (i=0-k1−1) of part of the section is also similar to the harmony information train H(j) (j=k4-k5−1) of the section corresponding to the high-degree-of-similarity successive region L2. Namely, the section starting at the beginning of the music piece, which is the source of the harmony information train H(i) (i=0-k2−1), comprises a former-half section A and latter-half section B. It is assumed that the same chords as in the sections A and B are repeated in the section corresponding to the high-degree-of-similarity successive region L1, and that the same chords as in the section A are repeated in the high-degree-of-similarity successive region L2.

Harmony information train H(j) (j=k5-n−1) following the section corresponding to the high-degree-of-similarity successive region L2 is not similar to any one of the sections of the preceding harmony information train H(i) (i=0-k5−1). Thus, the harmony information train H(j) (j=k5-n−1) is determined to be a new section C.

Through the above-described operations, the analysis section 110 divides the harmony information train H(k) (k=0-n−1) into sections (sections A, B, A, B, A and C in the illustrated example of FIG. 4B) corresponding to various chords and then obtains chords being performed in the individual sections. In this way, it is possible to obtain chord change points on the time axis. Each given one of sudden change points of level 2 which is closest to a chord change point is set as a sudden change point of level 3. Such a chord sequence generation technique based on harmony information is disclosed, for example, in non-patent literature 2 identified earlier.

Alternatively, sudden change points of level 3 may be obtained by another scheme than the aforementioned schemes using the beat point and measure line detection, chord sequence detection, etc. Namely, sudden change points of level 3 may be obtained by obtaining, for each of sections defined by division at sudden change points of level 2, characteristic amounts, such as a Spectral Centroid indicative of a tone pitch feeling, Loudness indicative of a tone volume feeling, Brightness of indicative of auditory brightness of a tone, Noisiness indicative of auditory roughness, etc. and then comparing distributions of the characteristic amounts of the individual sections.

For example, a first sudden change point of level 2 from the beginning of the music piece is selected as a target sudden change point of level 2. Then, from the music piece data of the music piece are obtained an average and distribution of characteristic amounts of a section sandwiched between the beginning of the music piece and the selected first sudden change point of level 2 (hereinafter "inner section"), and an average and distribution of characteristic amounts of a section following the selected first sudden change point of level 2 (hereinafter "outer section"). Then, a difference between the distribution of the characteristic amounts of the inner section and the distribution of the characteristic amounts of the outer section is obtained. The same operations are repeated with the target sudden change point of level 2 (which is an end point of the inner section) sequentially changed to a second sudden change point of level 2, third sudden change point of level 2, and so on. Namely, with the sudden change point of level 2 in the inner section sequentially changed, a difference between the distribution of the characteristic amounts of the inner section and the distribution of the characteristic amounts of the outer section is obtained, and one of the sudden change point of levels 2, which represents the greatest difference, is set as a first sudden change point of level 3. Next, the first sudden change point of level 3 is set as a start point of an inner section. With the end point of the inner section sequentially selected from among sudden change points of level 2 following the start point of the inner section, a difference between the distribution of the characteristic amounts of the inner section and the distribution of the characteristic amounts of the outer section is obtained, and one of the sudden change point of levels 2, which represents the greatest difference, is set as a second sudden change point of level 3. Then, third and subsequent sudden change points of level 3 are obtained using the same operational sequence as set forth above.

In another alternative, the analysis section 110 may cause the display section 3 to display a spectrogram and sudden change points of level 1 and audio waveforms and sudden change points of level 2, so that, under such a condition, the user can select a sudden change point of level 3 from among the displayed sudden change points of level 2, for example, through operation of the pointing device.

In addition to obtaining sudden change points of level 1-level 3 in the aforementioned manner, the analysis section 110 generates musical characteristic data quantitatively indicative of musical characteristics of individual sound fragment data obtained by dividing music piece data at sudden change points of level 1.

The analysis section 110 in the instant embodiment further determines whether the sound fragment data has any of musical characteristics as listed below, and, if an affirmative (YES) determination is made, it generates musical characteristic data indicative of the musical characteristic.

Blank: This is a musical characteristic of being completely silent or having no prominent high-frequency component. Audio signal having been passed through an LPF has this musical characteristic "Blank".

Edge: This is a musical characteristic imparting a pulsive or attack feeling. Among cases where this musical characteristic Edge appears are the following two cases. First, a bass drum sound has this musical characteristic Edge if though it has no high-frequency component. Further, in a case where a spectrogram of specific sound fragment data has, up to 15 kHz, a clear boundary between a dark region (i.e., portion having a weak power spectrum) and a bright region (i.e., portion having a strong power spectrum), that sound fragment has this musical characteristic Edge.

Rad: When sound fragment data has a sharp spectral peak in a medium frequency band (particularly, in the neighborhood of 2.5 kHz), the sound fragment has this musical characteristic Rad. Portion having the musical characteristic Rad is located in the middle between the start and end points of a tone. This portion contains components of wide frequency bands and can be imparted with a variety of tone color variation, and thus, the portion is a useful portion in music creation.

Flat: This is a musical characteristic that a chord is clear. Whether or not the sound fragment data is flat or not can be determined through the above-mentioned HPCP.

Bend: This is a musical characteristic that a pitch of the sound fragment data is clearly changing in a given direction.

Voice: This a musical characteristic of having much of a typical character of human voice.

Dust: This is a musical characteristic of having much of a typical character of sound noise. Although the sound fragment data having the characteristic "dust" may sometimes have a pitch, sound noise is more prominent in the sound fragment data. Sustain portion of a hi-hat cymbal sound, for example, has the musical characteristic "dust". Note that an attack portion of a hi-hat cymbal sound has the above-mentioned musical characteristic "edge".

Further, the analysis section 110 analyzes each of the sound fragment data obtained by dividing at the sudden change points the music piece data stored in the RAM 7 and then obtains an index indicative of complexity of the sound fragment data. Such an index indicative of complexity may be any one of various types of indices. For example, intensity of spectral variation of a tone volume and/or frequency in a spectrogram of the sound fragment data may be used as the index of complexity. For example, intensity of spectral texture variation may be used as intensity of frequency spectral variation. In the instant embodiment, the analysis section 110 obtains such an index of complexity for each sound fragment data of each section sandwiched (or defined) between sudden change points of level 1, each section sandwiched between sudden change points of level 2 and each section sandwiched between sudden change points of level 3. This is for the purpose of allowing the display control section 121 to display menus of the individual sound fragment data to be displayed on the display section 3 in the order of their complexity, irrespective of which one of level 1-level 3 the has been used to divide the music piece data into a plurality of sound fragment data.

Figure 5:
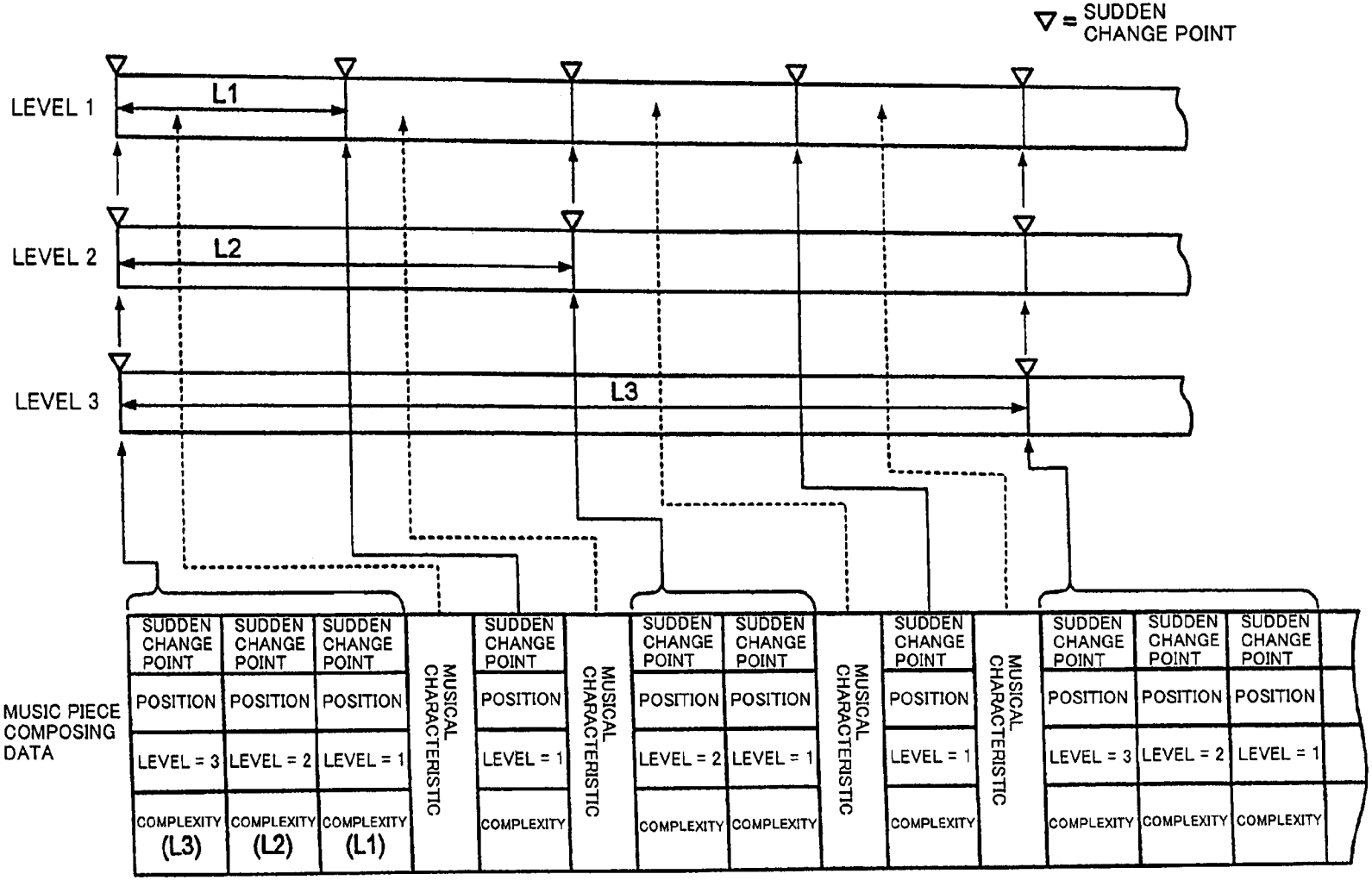
FIG. 5 is a diagram showing an example setup of music piece composing data created by an analysis section in the embodiment of the present invention.

The analysis section 110 constructs music piece composing data using the sudden change point data and musical characteristic data having been acquired in the aforementioned manner. FIG. 5 is a diagram showing an example setup of the music piece composing data. To facilitate understanding of the music piece composing data. FIG. 5 shows music piece data divided at sudden change points of level 1-level 3 in three horizontal stripes, and also shows which portions of the music piece data individual data included in the music piece composing data pertain to.

As shown in an upper half of FIG. 5, the sudden change points of level 2 are also the sudden change points of level 1, and the sudden change points of level 3 are also the sudden change points of level 2. Although there are overlaps in sudden change point among the different levels L1-L3, the instant embodiment creates sudden change point individually for each of the levels. Namely, if, for example, there are sudden change points of level 3-level 1 at a same time point, sudden change point data of level 3 is positioned first in the music piece composing data, then sudden change point data of level 2 and then sudden change point data of level 1, as shown in a lower half of FIG. 5. Immediately following the sudden change point data of level 1, there is positioned musical characteristic data of sound fragment data starting at the sudden change point indicated by the sudden change point data of level 1. The end point of the sound fragment data is the sudden change point indicated by the next sudden change point data of level 1, or the end point of the music piece.

Each of the sudden change point data includes an identifier indicating that the data in question is sudden change point data, data indicative of a relative position of the sudden change point as viewed from the beginning of the music piece, and data indicative of complexity of sound fragment data starting at the sudden change point.

In the case of the sudden change point data of level 3, the data indicative of complexity indicates complexity of sound fragment data in a section L3 from the sudden change point indicated by that sudden change point data of level 3 to next sudden change point data of level 3 (or to the end point of the music piece). Further, in the case of the sudden change point data of level 2, the data indicative of complexity indicates complexity of sound fragment data in a section L2 from the sudden change point indicated by that sudden change point data of level 2 to next sudden change point data of level 2 (or to the end point of the music piece). Furthermore, in the case of the sudden change point data of level 1, the data indicative of complexity indicates complexity of sound fragment data in a section L1 from the sudden change point indicated by that sudden change point data of level 1 to next sudden change point data of level 1 (or to the end point of the music piece).

The foregoing have been a detailed description about behavior of the analysis section 110.

Next, a description will be given about behavior of the creation section 120. The display control section 121 of the creation section 120 divides given music piece data, stored in the RAM 7, into a plurality of sound fragment data on the basis of the sudden change point data included in the corresponding music piece composing data. Unless particularly instructed otherwise by the user, the display control section 121 divides the music piece data, stored in the RAM 7, into a plurality of sound fragment data on the basis of the sudden change point data of level 3 included in the corresponding music piece composing data. Then, the display control section 121 causes the display section 3 to display a menu, listing up the individual sound fragment data, in a particular format where the individual sound fragment data are arranged in the order of their complexity.

Figure 6:
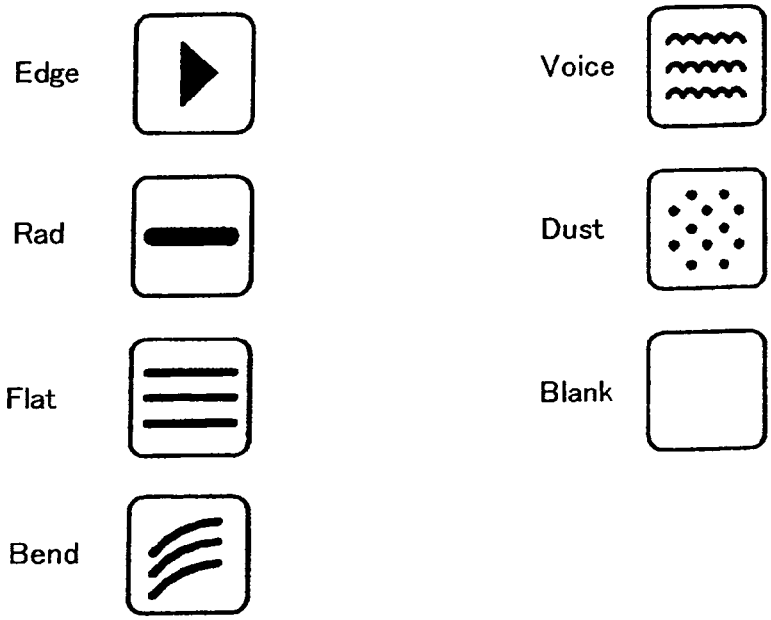
FIG. 6 is a diagram showing marks used to indicate musical characteristics of sound fragment data in the embodiment of the present invention.
Figure 7:
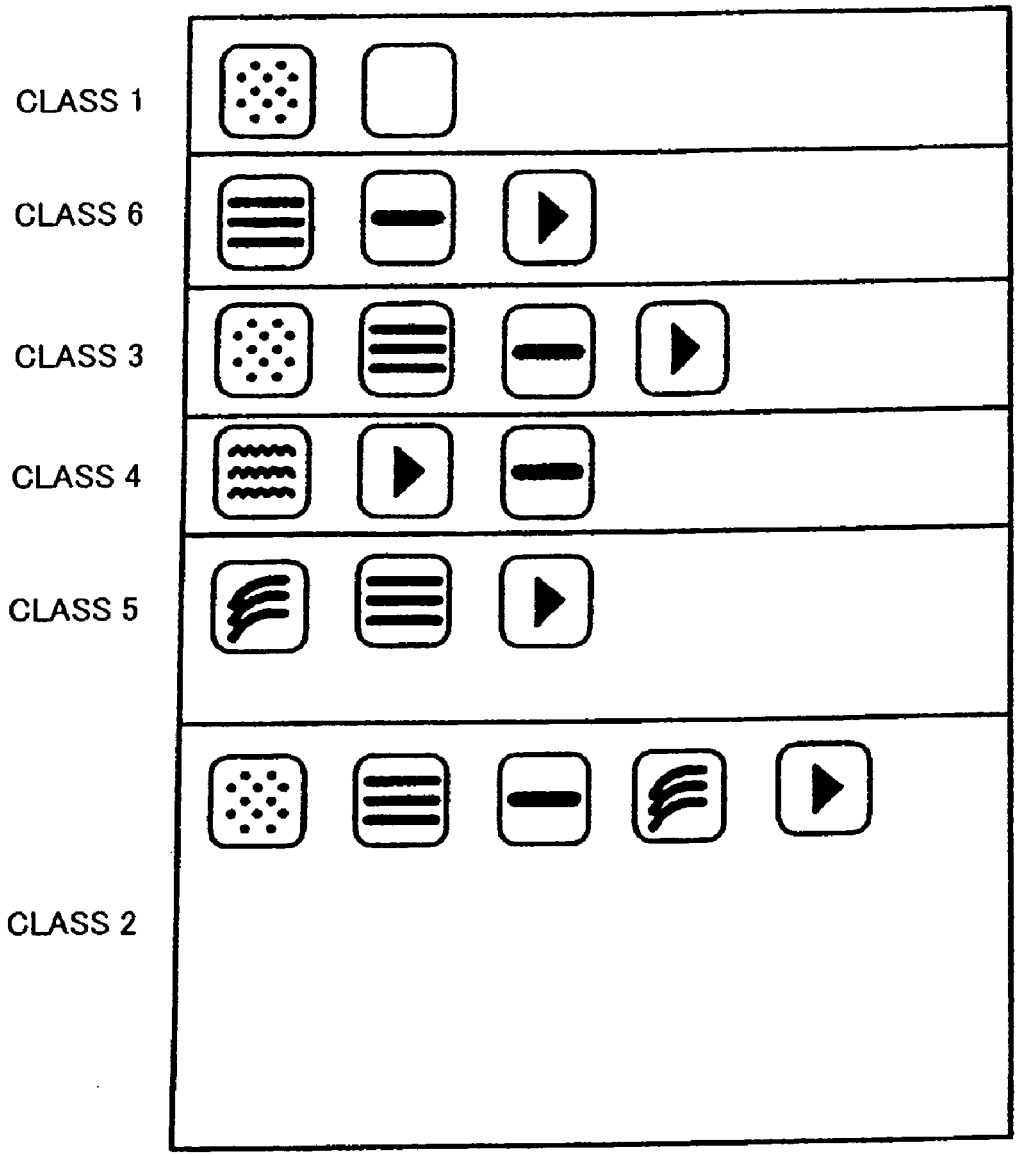
FIG. 7 is a diagram showing marks indicative of sound fragment data and marks indicative of musical characteristics of the sound fragment data.

In displaying the individual sound fragment data in the menu format on the display section 3, the display control section 121 also display marks indicative of musical characteristics, associated with the sound fragment date, together with the sound fragment data. More specifically, each of the sound fragment data divided from each other at the sudden change point of level 3 includes one or more sound fragment data divided from each other at the sudden change point of level 1. Therefore, the menu of the sound fragment data divided from each other at the sudden change point of level 3 will include marks (icons or symbols) indicative of musical characteristics of the one or more sound fragment data divided from each other at the sudden change point of level 1. In the instant embodiment, marks illustratively shown in FIG. 6 are marks (icons or symbols) of the musical characteristic data Edge, Rad, Flat, Bend, Voice, Dust and Blank. In FIG. 7, there is shown a menu of the sound fragment data divided from each other on the basis of the sudden change point data of level 3 (in the illustrated example of FIG. 7, "class 1", "class 6", etc), as well as the marks indicative of the musical characteristics of the individual sound fragment data. In the instant embodiment, the classes are displayed in a vertically-arranged format in the order of ascending structural complexity on the basis of the indices of structural complexity. Sometimes, one class may have a plurality of musical characteristics. In such a case, for each of the classes, the individual musical characteristics possessed by the class are displayed in a horizontally-arranged form (i.e., in a horizontal row). The order in which the musical characteristics are arranged horizontally may be set to conform to the order in which the musical characteristics appear in the music piece or to an occurrence frequency of the musical characteristics. In the illustrated example of FIG. 7, a vertical length of each of display areas for displaying the marks indicative of the musical characteristics of the individual sound fragment data is set to reflect the time lengths of the individual sound fragment data. Alternatively, a horizontal bar or the like of a length reflecting the time lengths of the individual sound fragment data may be displayed within each of the display areas.

Figure 8:
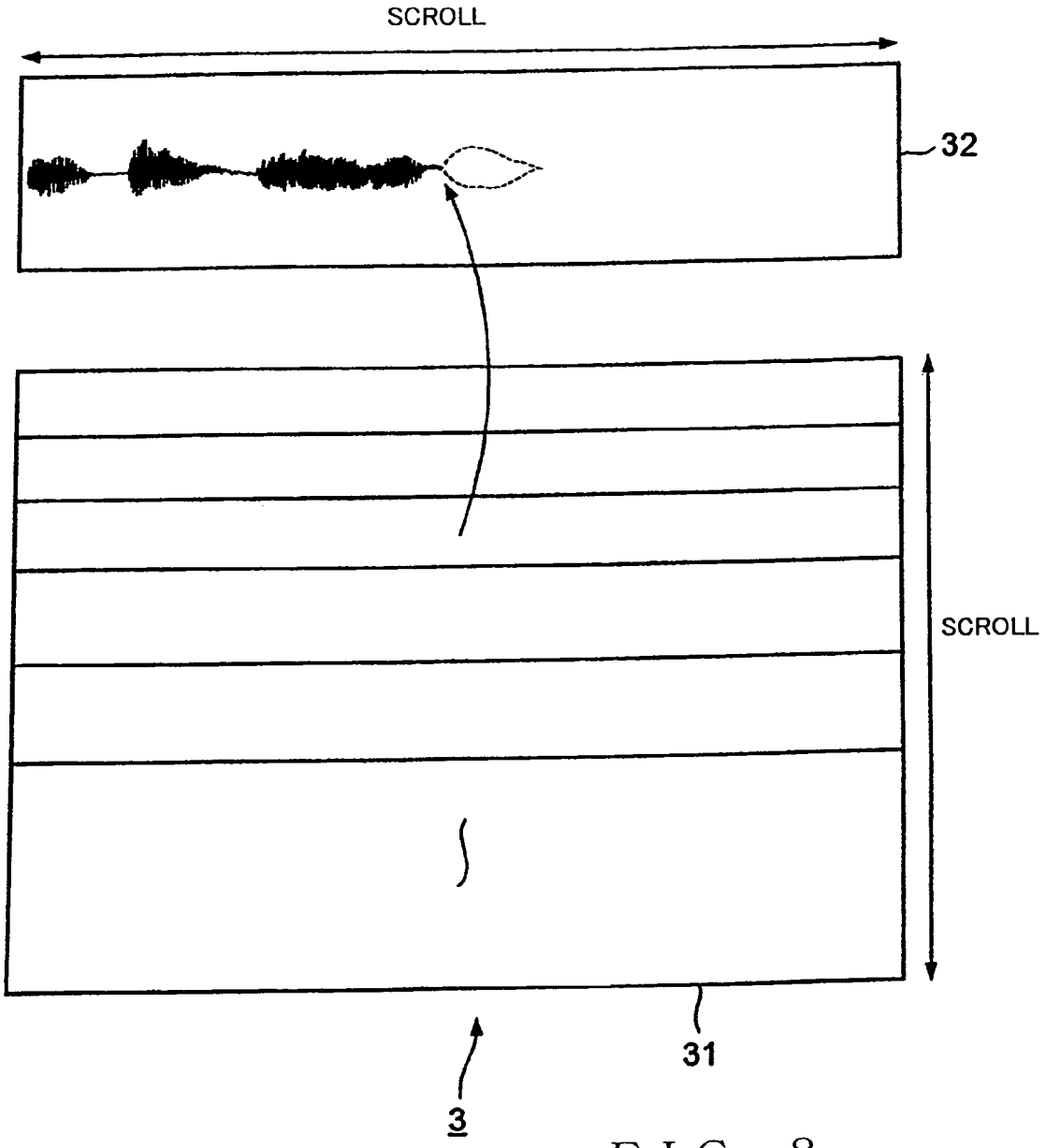
FIG. 8 is a diagram showing a sound fragment display area and music piece display area displayed on a display section in the embodiment of the present invention.

In a preferred implementation, a display screen of the display section 3, as shown in FIG. 8, is divided broadly into a lower-side sound fragment display area 31 and an upper-side music piece display area 32. The display control section 121 displays, in the lower-side sound fragment display area 31, menus (more specifically, sub-menus) of sound fragment data and marks indicative of musical characteristics of the sound fragment data. Displayed content in the sound fragment display area 31 can be scrolled vertically (in an upward/downward direction) in response to user's operation via the operation section 4. The upper-side music piece display area 32 is an area for displaying audio waveforms represented by music piece data being created. In the figure, the time axis lies in a horizontal direction. Displayed content in the music piece display area 32 can be scrolled horizontally (in a leftward/rightward direction) in response to user's operation via the operation section 4.

During a time that the display control section 121 is performing control to display, in the sound fragment display area 31, the sound fragment data menus and marks indicative of musical characteristics of the sound fragment data, the synthesis section 122 stores the sound fragment data into the music piece track within the RAM 7 to thereby synthesize new music piece data. More specifically, the synthesis section 122 causes the grid indicative of the time axis scale of the music piece track to be displayed in the music piece display area 32 (not shown). Once one of the sound fragment data menus (sub-menus) displayed in the sound fragment display area 31 is selected in response to user's operation via the operation section 4 (more specifically, the pointing device), the synthesis section 122 cuts out and reads out the sound fragment data corresponding to the selected menu from among the music piece data in the RAM 7. Then, once one of the grid points displayed in the music piece display area 32 is designated through operation via the operation section 4, the sound fragment data are stored into a successive region, located in the music piece track of the RAM 7, starting with an address corresponding to the designated grid point. The synthesis section 122 repeats such operations in accordance with operation via the operation section 4, to interconnect various sound fragment data and thereby generate new music piece data in the music piece track in the RAM 7.

In a preferred implementation, when one sound fragment data has been selected, the synthesis section 122 reads out the selected sound fragment data from the RAM 7 and sends the read-out sound fragment data to the sound system 8 so that the sound fragment data is audibly reproduced via the sound system 8. In this way, the user can confirm whether or not he or she has selected desired sound fragment data.

Once the user gives a reproduction instruction through operation via the operation section 4 with music piece data stored in the music piece track, the synthesis section 122 reads out the music piece data from the music piece track and sends the read-out music piece data to the sound system 8 so that the music piece data are output as audible sounds via the sound system 8. In this way, the user can confirm whether or not a desired music piece could be created. Then, once the user gives a storage instruction through operation via the operation section 4, the synthesis section 122 stores the music piece data into the music piece track into the HDD 6 as a music piece data file 62.

The foregoing have described behavior of the instant embodiment in relation to the case where the display control section 121 uses the sudden change point data of level 3 to divide music piece data. However, the user can designate, through operation via the operation section 4, any desired one of the levels of the sudden change point data to be used for the division of music piece data. In this case, the display control section 121 uses the sudden change point data of the designated level, selectively read out from among the sudden change point data included in the music piece composing data, to divide the music piece data into sound fragment data. The display control section 121 has been described above as synthesizing new music piece data using the sound fragment data obtained by dividing one music piece data set at predetermined sudden change points. Alternatively, however, the display control section 121 in the instant embodiment may synthesize new music piece data using sound fragment data obtained by dividing a plurality of music piece data sets at predetermined sudden change points. In such a case, the user only has to designate a plurality of music piece data files 62 through operation via the operation section 4, and cause the analysis section 110 to create music piece composing data for each of the music piece data files. In this alternative, the embodiment behaves in essentially the same manner as described above.

According to the instant embodiment, as described above, one or more music piece data sets are divided at sudden change points into sound fragment data, and a menu indicative of the individual sound fragment data as materials to be used for creation of a music piece is displayed on the display section 3. At that time, the menu is displayed on the display section 3 in the format having the individual sound fragment data arranged therein in the order of ascending structural complexity such that a shift is made from the sound fragment data of low structural complexity to the sound fragment data of higher structural complexity. Thus, the user can readily find any desired sound fragment data. Further, according to the instant embodiment, marks indicative of musical characteristics of the individual sound fragment data are displayed on the display section 3 along with the sound fragment data menu. In this way, the user can readily imagine the content of each of the sound fragment data displayed in the menu format and thus can promptly find any desired one of the sound fragment data.

Whereas one preferred embodiment of the present invention has been described so far, various other embodiments are also possible as briefed below.

(1) Part or whole of the music piece creation program 61 may be replaced with electronic circuitry.

(2) When a predetermined user's instruction has been given through operation via the operation section 4, marks indicative of sound fragment data may be displayed on the display section 3 in the order of occurrence or appearance in the music piece rather than in the order of structural complexity.

(3) As part of a "class" menu, a waveform or spectrogram of a sound fragment of the class may be displayed on the display section 3. Further, positions of sudden change points of level 1 and level 2 may be specified in the display of the waveform or spectrogram of the sound fragment.

(4) If the user has selected a "class" menu (sub-menu), a menu for the user to select "full copy" or "partial copy" may be displayed. If the user has selected "full copy", then the entire sound fragment data of the selected class is used for synthesis of music piece data. If, on the other hand, the user has selected "partial copy", then a sub-menu of sound fragment data obtained by dividing the selected class at sudden change points of a lower level (i.e., level 2) is displayed on the display section 3, so that sound fragment data selected by the user through operation via the operation section 4 are used to synthesize music piece data. In this alternative, music piece data can be synthesized by combined use of class-by-class sound fragment data interlinking (full copy) and lower-level sound fragment data interlinking (partial copy), and thus, more flexible music piece creation is permitted. Note that, in such a case, the sound fragment data order in which the sound fragment data obtained at lower-level sudden change points are to be displayed in the menu on the display section 3 may be either the order of occurrence of the sound fragment data in the class or the order of structural complexity.

(5) The sound fragment data may be classified into groups that are suited, for example, for rhythm performances and melody performances, and a menu of the sound fragment data belonging to a group selected by the user through operation via the operation section 4 may be displayed so that the user can select desired ones of the sound fragment data from the menu.

(6) If the user designates any of a filtering process, pitch conversion process, tone volume adjustment process, etc. after selecting music piece data to be stored into the music piece track, the user-selected sound fragment data may be subjected to the user-designated process and then stored into the music piece track.

(7) To the music piece creation program 61 may be added a function of storing music piece composing data, created by the analysis section 110, into the HDD 6 as a file, and a function of reading out the music piece composing data from the HDD 6 and passing the read-out music piece composing data to the creation section 120. This alternative can eliminate a need for creating again music piece composing data for music piece data of which music piece composing data has been created once, which allows music piece data to be created with an enhanced efficiency.

This application is based on, and claims priority to, JP PA 2007-184052 filed on 13 Jul. 2007. The disclosure of the priority applications, in its entirety, including the drawings, claims, and the specification thereof, is incorporated herein by reference.

What is claimed is:

1. A music piece creation apparatus comprising:

a storage section that stores music piece data composed of audio waveform data;

an analysis section that analyzes the music piece data stored in said storage section to determine sudden change points of sound condition in the music piece data;

a display device;

a display control section that causes said display device to display individual sound fragment data, obtained by dividing at the sudden change points the music piece data stored in said storage section, in a menu format having the sound fragment data arranged therein in order of complexity;

an operation section operable by a user, said operation section accepting user's operation for selecting desired sound fragment data from the menu displayed on said display device and user's operation for designating a time-axial position where the selected sound fragment data is to be positioned; and a synthesis section that synthesizes new music piece data by positioning each sound fragment data, selected from the menu through user's operation via said operation section, at a time-axial position designated through user's operation via said operation section.

2. The music piece creation apparatus as claimed in claim 1 wherein said analysis section determines a musical characteristic of each of the sound fragment data obtained by dividing at the sudden change points the music piece data stored in said storage section, and said display control section causes said display device to display marks indicative of the musical characteristics of the individual sound fragment data along with the menu of the individual sound fragment data.

3. The music piece creation apparatus as claimed in claim 1 wherein said analysis section determines a plurality of types of the sudden change points differing from each other in level of importance, the user is allowed to designate a desired level of importance of the sudden change point by operating said operation section, and said display control section divides the music piece data at the sudden change points corresponding to the level of importance designated through user's operation via said operation section.

4. The music piece creation apparatus as claimed in claim 1 wherein said analysis section determines a plurality of types of the sudden change points differing from each other in level of importance, and said display control section divides the music piece data into a plurality of the sound fragment data at the sudden change points corresponding to a first level of importance, and wherein, when one of the sound fragment data is selected, through operation via said operation section, from the menu displayed on said display device, said display control section divides the selected sound fragment data into a plurality of further sound fragment data at the sudden change points corresponding to a second level of importance and causes said display device to display a menu of the divided further sound fragment data.

5. The music piece creation apparatus as claimed in claim 1 wherein the sudden change points of sound condition determined by said analysis section are each a sudden change point pertaining to at least one of band frequency components, tone volume and other tone factor.

6. The music piece creation apparatus as claimed in claim 1 wherein said analysis section further analyzes a musical characteristic of each of the sound fragment data obtained by dividing at the sudden change points the music piece data stored in said storage section, and wherein, when causing said display device to display the individual sound fragment data, obtained by dividing the music piece data at the sudden change points, in the menu format having the sound fragment data arranged therein in order of complexity, said display control section displays, in the menu, icons indicative of the musical characteristics of the individual sound fragment data analyzed by said analysis section.

7. The music piece creation apparatus as claimed in claim 1 wherein said analysis section further analyzes complexity of each of the sound fragment data obtained by dividing at the sudden change points the music piece data stored in said storage section, to thereby generate indices indicative of the analyzed complexity of the individual sound fragment data, and wherein said display control section arranges the individual sound fragment data, obtained by dividing at the sudden change points the music piece data stored in said storage section, in the order of complexity on the basis of the indices indicative of the analyzed complexity of the sound fragment data.

8. The music piece creation apparatus as claimed in claim 7 wherein said complexity is determined on the basis of spectral variation of the sound fragment data.

9. A computer-implemented method for creating a music piece, comprising:

a step of analyzing music piece data stored in a memory storing music piece data composed of audio waveform data, to thereby determine a sudden change points of sound condition in the music piece data;

a step of causing a display device to display individual sound fragment data, obtained by dividing at the sudden change points the music piece data stored in the memory, in a menu format having the sound fragment data arranged therein in order of complexity;

a step of accepting user's operation for selecting desired sound fragment data from the menu displayed on the display device;

a step of accepting user's operation for designating a time-axial position where the selected sound fragment data is to be positioned; and a step of synthesizing new music piece data by positioning each sound fragment data, selected by the user, at a time-axial position designated by the user.

10. A computer-readable medium containing a group of instructions for causing a processor to perform a music piece creation procedure, said music piece creation procedure comprising:

a step of analyzing music piece data stored in a memory storing music piece data composed of audio waveform data, to thereby determine a sudden change points of sound condition in the music piece data;

a step of causing a display device to display individual sound fragment data, obtained by dividing at the sudden change points the music piece data stored in the memory, in a menu format having the sound fragment data arranged therein in order of complexity;

a step of accepting user's operation for selecting desired sound fragment data from the menu displayed on the display device;

a step of accepting user's operation for designating a time-axial position where the selected sound fragment data is to be positioned; and a step of synthesizing new music piece data by positioning each sound fragment data, selected by the user, at a time-axial position designated by the user.

* * * * *